United States Patent [19]

Sklena et al.

[11] 3,931,892

[45] Jan. 13, 1976

[54] COMPONENT HANDLER WITH FLUID CONTROLLED MEMORY

[75] Inventors: Martin L. Sklena, Costa Mesa; Russell P. Balent, Balboa Island; Phillip E. Greer, Tustin, all of Calif.

[73] Assignee: GTI Corporation, Costa Mesa, Calif.

[22] Filed: May 24, 1974

[21] Appl. No.: 472,978

[52] U.S. Cl. ..... 209/74 M; 324/158 R; 74/3.52; 209/81

[51] Int. Cl.[2] ..... B07C 5/08

[58] Field of Search..... 209/74, 74 M, 81, 75, 73; 324/158 T, 158 F; 74/3.52; 214/11 C

[56] References Cited

UNITED STATES PATENTS 3,761,806 9/1973 Napor ..... 209/81 R 3,834,531 9/1974 Bollerup ..... 209/74 M

*Primary Examiner*—Allen N. Knowles

*Attorney, Agent, or Firm*—George F. Smyth

[57] ABSTRACT

A component handler including a holder for holding components while a test or other operation is performed thereon, a body having a plurality of passages therein, a plurality of members movable in said passages, respectively, from a first position to a second position, and a mechanism for providing fluid under pressure for moving the movable members from the first position to the second position. The mechanism can be controlled, for example, by the results of the test on the components.

21 Claims, 10 Drawing Figures

COMPONENT HANDLER WITH FLUID CONTROLLED MEMORY

BACKGROUND OF THE INVENTION

Various electrical components such as capacitors, diodes, and resistors are often made in the form of very small chips. Before using the chips, they must be subjected to various electrical tests and then sorted in accordance with the results of the test. In a typical case, a component is tested to assure that it meets appropriate specifications, and the sorting process then involves separating the acceptable chips from the rejects.

Typical prior art component handlers provide for testing and sorting only one component at a time. For example, one prior art component handler sequentially picks up the component, moves the component to a test jig where a tester electrically tests the component, and the moves the component to an appropriate bin depending upon the test results.

Common assignee's copening application Ser. No. 415,741, filed on Nov. 14, 1973, and entitled "Component Handler and Method and Apparatus Utilizing Same" discloses a component handler which enables the tester to work at a greater speed to thereby substantially increase the testing rate. In addition, this component handler greatly increases the sorting rate.

To increase the testing rate, a large number of components are retained in a holder and each component is rapidly sequentially electrically coupled to a tester which performs whatever tests are desired. To increase the sorting rate, the test results are stored in a memory and the memory is then used to selectively remove components from the holder in accordance with the test results. In order to permit the memory to remove components from the holder, the memory includes a body and a plurality of memory members or ejector members, and the holder has a plurality of openings therein adapted to receive the components, respectively. The openings and the ejector members are arranged in substantially identical patterns. The programming of the memory includes positioning of the ejector members in either an extended or retracted position. After the memory is full programmed, the memory and holder are juxtaposed so that the ejector members in the ejecting position can extend into corresponding openings of the holder to eject the associated components into an appropriate bin.

SUMMARY OF THE INVENTION

The component handler of the above-mentioned copending application provides a substantial advance in the art. The purpose of the present invention is to make certain improvements to this and other component handlers.

With the component handler of the copending application a solenoid is moved from station to station along with the ejector to selectively move the ejector members to the extended position. While an arrangement of this type is workable, it does require accurate positioning of the solenoid and the ejector in order that the solenoid plunger can enter the appropriate small diameter passage of the ejector body in which the ejector member is contained to force the ejector member to the extended position. In addition, while the solenoid plunger is extended into one passage of the ejector body, extension and retraction of the solenoid cannot be in transit to the next station.

The present invention solves these problems by providing means for providing fluid under pressure for moving the ejector members from the retracted position to the extended position. The jet of air may be provided through an opening or nozzle. Because there is no mechanical interlocking of the nozzle and the ejector, the nozzle need not be accurately positioned with respect to the passage in the ejector. In addition, the nozzle may move continuously to the ejector and need not stop at each of the passages in the ejector.

In the construction described in the copending application, after an ejector member is moved to the extended position, it is magnetically releasably retained in the extended position. While this arrangement is quite workable, it is somewhat difficult to implement and the magnets are somewhat costly.

Accordingly, the present invention provides for frictionally retaining the ejector members in the extended position. This is particularly compatible with utilizing fluid to move the ejector member in that frictional retention can be provided by a resilient seal carried by the ejector member. Thus, the resilient seal performs the dual functions of sealing against the motive fluid and releasably retaining the ejector member in the extended position.

The ejector may serve solely as a memory. The ejector may also be used in different ways as programmable sorting means to sort the tested compounds in accordance with the test results. For example, the ejector may be used as an implement for physically ejecting the components. In this event and others, it is desirable to positively retain in the extended position all of the ejector members which have been moved to the extended position. This can be advantageously accomplished if the body of the ejector includes a locking plate. The locking plate has aperture means through which the ejector members can project. The locking plate is slidable in the body to lock the ejector members in the extended position.

To conduct a test of the components, a contact and the holder of the components are moved relative to each other so that the contact is sequentially brought into electrical contact with each of the components. While electrical contact is made a suitable testing apparatus performs the necessary test and provides a testing signal which is indicative of the result of such test. To program the ejector in accordance with the test results, the ejector and nozzle must be properly relatively positioned, assuming that the nozzle is to serve two or more ejector members. For example, if one ejector member is provided for each component the nozzle is positioned so that it can direct fluid under pressure toward the ejector member corresponding to the component then being engaged by the contact. Then, if the testing signal so requires, fluid under pressure is released through the nozzle to move the ejector member to the extended position. In order to provide sufficient time for conducting of the test and consequent opening of fluid control valves, the present invention provides for the nozzle-ejector relative motion to lag slightly behind the contact-holder relative motion. In order words, when the contact and a component are first brought into electrical contact, the nozzle and the associated ejector member are not yet positioned so that the nozzle could cause the ejector member to be moved to the extended position.

The invention can best be understood by reference to the following description taken in connection with the accompanying illustrative drawings.

DESCRIPTION OF THE PREFERRED EMBODIMENT

Figure 1:
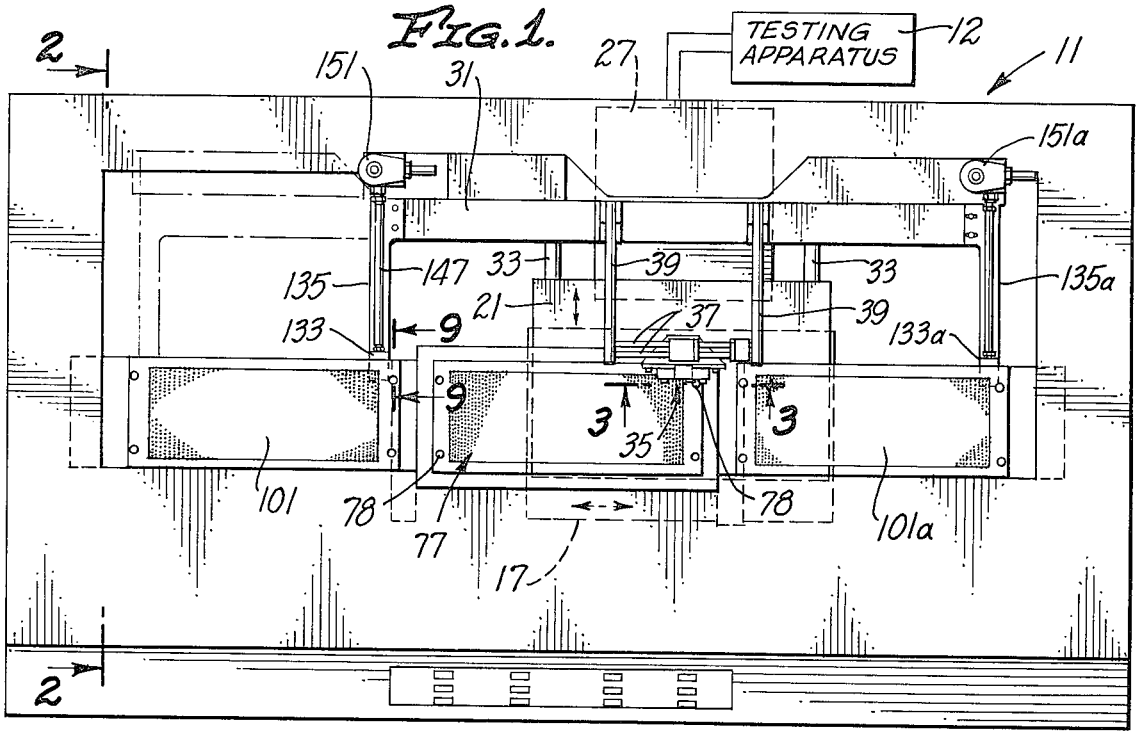
FIG. 1 is a top plan view of a component handler constructed in accordance with the teachings of this invention.
Figure 2:
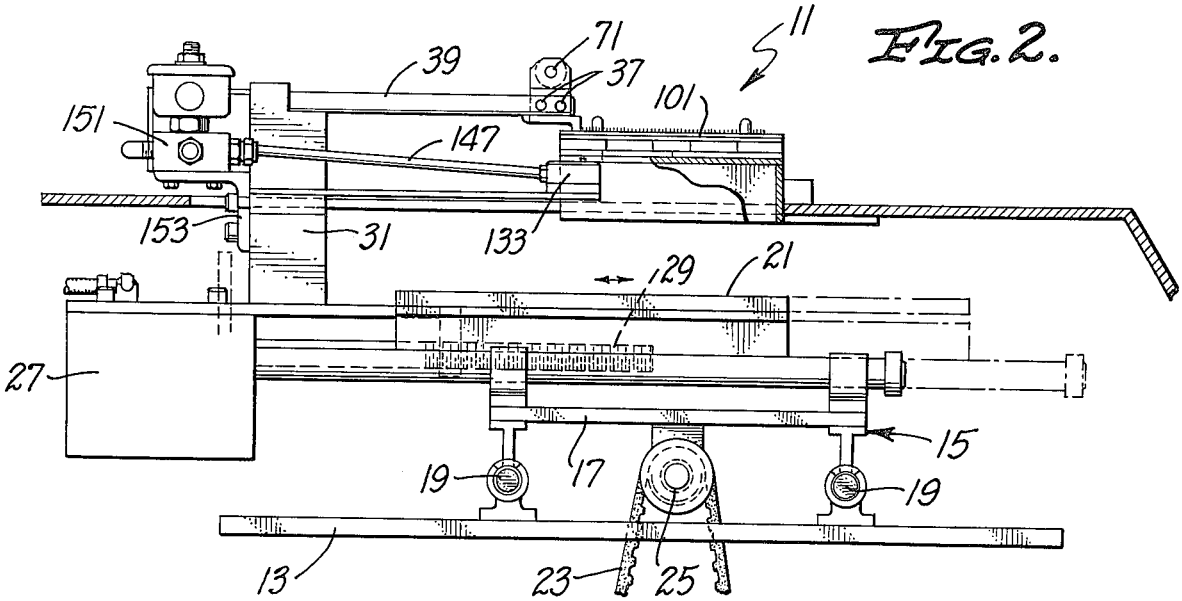
FIG. 2 is an enlarged sectional view taken generally along line 2—2 of FIG. 1.

FIGS. 1 and 2 show a component handler 11 constructed in accordance with the teachings of this invention. The component handler 11 is adapted for use with another item of equipment such as a testing apparatus 12.

The component handler 11 includes a stationary supporting structure 13 on which an X-Y table 15 is mounted. The X-Y table includes a lower platform 17 mounted for movement in one horizontal direction by a pair of guides 19 affixed to the supporting structure 13 and an upper platform 21 mounted on the lower platform in any suitable manner for movement in the other horizontal direction. The platform 17 can be driven in a conventional manner by a motor (not shown) through a belt drive 23 and a suitable lead screw and nut arrangement 25. Similarly, the platform 21 is driven by a motor 27 and lead screw 29. The X-Y table 15 is a commercially available item and does not, per se, form any part of the present invention.

A frame 31 is mounted on the upper platform 21 in any suitable manner such as by a pair of guide rods 33 for movement with, and relative to, the platform. The function of the X-Y table 15 is to accurately position the frame 21 and the members affixed thereto in a horizontal plane. Obviously, means other than an X-Y table could be utilized to accomplish this positioning function.

Figure 3:
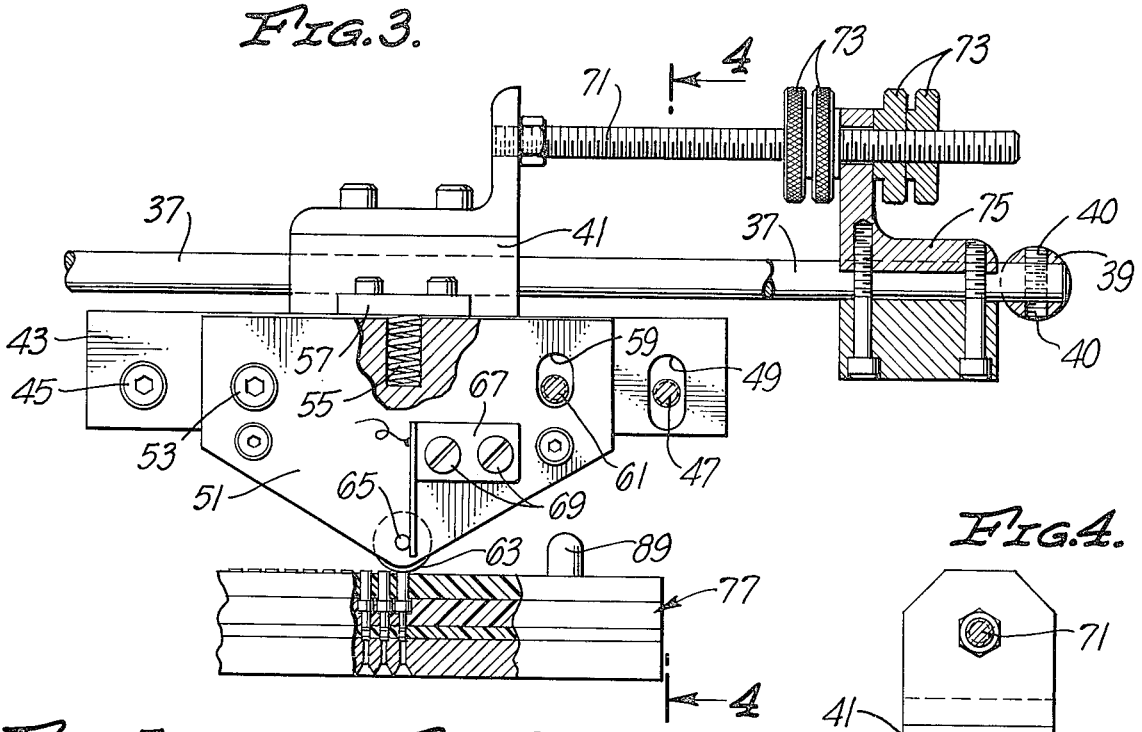
FIG. 3 is an enlarged, fragmentary front elevational view partially in section showing a portion of the component handler.

As shown in FIG. 1, a contact assembly 35 is mounted on a pair of rods 37 which in turn are supported by a pair of supports 39 which project from the frame 31. As shown in FIG. 3, the ends of the rods 37 are received within bores in the supports 39 and retained therein by set screws 40.

Figure 4:
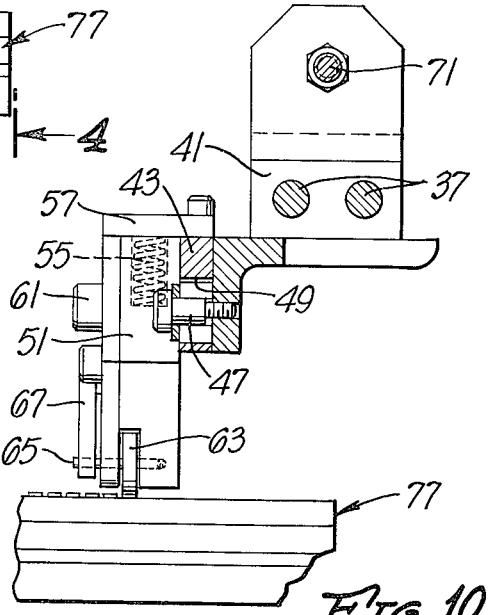
FIG. 4 is a fragmentary, sectional view taken generally along line 4—4 of FIG. 3.

As best shown in FIGS. 3 and 4, the contact assembly 35 includes a bracket 41 slidably mounted on the rods 37 and a mounting member 43 suitably pivotally attached to the bracket 41 as by a screw 45. The angular position of the mounting member 43 about the screw 45 can be adjusted by a screw 47 which extends through a slot 49 in the mounting member 43 into the bracket 41. By tightening of the screw 47, the mounting member 43 is tightly clamped between the head of the screw and the bracket 41 to thereby fix the mounting member 43 in a selected position.

A body member 51 is pivotally attached to the mounting member 43 in any suitable manner such as by a screw 53. A coil compression spring 55 is carried in a cavity in the body member 51 and acts against a tab 57 mounted on the mounting member 43 to urge the body member 51 clockwise as viewed in FIG. 3 about the screw 53. The amount of pivotal movement which the body member 51 can undergo about the screw 53 is limited by a slot 59 formed in the body member and a screw 61 which passes through this slot and is attached to the mounting member 43.

A contact in the form of a contact wheel 63 is rotatably mounted on the body member 51 by a pin 65. The contact wheel and the pin 65 are electrically conductive, and the pin is in contact with an arm of a conductive bracket 67. The bracket 67 is attached to the body member 51 by screws 69 which form electrical terminals.

With this construction, the contact assembly 35 can be moved as desired in the X-Y plane by the X-Y table 15. The mounting of the contact assembly 35 as shown in FIGS. 3 and 4 permit the contact wheel 63 to move vertically as necessary to accommodate any surface irregularities which the contact wheel 63 may encounter. Specifically, a rough vertical adjustment of the height of the contact wheel 63 can be made by the screw 47. Thereafter, viarations in surface contour are automatically accommodated by the slot 59 and the screw 63. The spring 55 maintains the contact wheel 63 in contact with the surface therebelow.

Various means could be employed to affix the bracket 41 to the rods 37 for movement therewith. In the embodiment shown in FIG. 3, the bracket 41 is attached by means of a screw 71 and two nuts 73 to a clamp assembly 75 which in turn is affixed to the rods 37. The nuts 73 clampingly engage the clamping assembly 75.

Holding means in the form of a holder 77 is removably and fixedly mounted on the supporting structure 13 immediately beneath the contact wheel 63 by dowels 78 (FIG. 1) which accurately locate the holder on the supporting structure. The holder 77 is adapted to hold a plurality of components 79. The component handler 11 is adapted to test and sort a variety of components, such as capacitors, diodes and resistors, and the component 79 is shown merely by way of example. The componenet 79 in the embodiment illustrated is a capacitor chip of conventional construction and includes a dielectric sandwiched between conductive electrodes 80*a* and 80*b*. The components 79 are characteristically very small.

Figure 5:
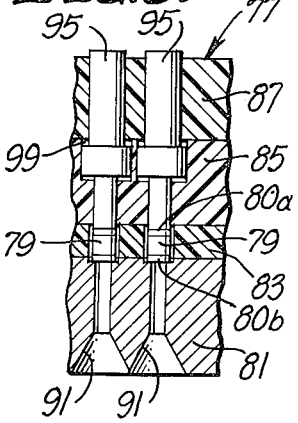
FIG. 5 is an enlarged, fragmentary sectional view of the holder for the components.

The holder 77 could be of various different constructions, and FIG. 5 illustrates a preferred construction. The holder 77 includes a conductive ground plate 81, a nonconductive holding plate 83, and a contact carrying section comprising insulating plates 85 and 87. The plates 81 and 83 are permanently bonded together and the plates 85 and 87 are also permanently bonded. The plates 85 and 87 may be releasably mounted on the plates 81 and 83 by a plurity of cooperating dowels 89 (only one being shown in FIG. 3) carried by the plates 85 and 87 and corresponding recesses formed in the plates 83 and 81. Numerous passages 91 extend through the ground plate 81 and the holding plate 83. With the plates 85 and 87 removed as permitted by the dowels 89, the components 79 can be loaded into the passages 91 using various known methods including the method described in common assignee's copending application Ser. No. 415,741.

One function of the ground plate 81 is to make electrical contact with all of the components 79. In other words, the ground plate 81 forms a common ground for all of the components 79. This result is brought about by the formation of annular shoulders 93 in each of the passages 91 in the ground plate 81 upon which conductive electrodes 80*b* can rest. The holding plate 83 laterally confines the components 79.

A primary function of the plates 85 and 87 is to mount contacts 95. Although the contacts 95 could take various different forms, in the embodiment illustrated, each of them is in the form of an elongated stem, the inner end of which is adapted to make electrical contact with the electrode 80*a* of the associated component 79 and the outer portion of which protrudes upwardly above the insulating plate 87. Each of the contacts 95 has a peripheral flange 97 which is received in a counterbore 99 of the conductive holding plate 85. The counterbore 99 is sufficiently long to allow limited axial sliding movement of the associated contact 95. The plates 85 and 87 also electrically insulate the contacts 95 from each other. With this arrangement, a circuit can be completed from the testing apparatus 12 to the terminals 69, the bracket 67, the pin 65, the contact wheel 63, the contact 95 engaged by the contact wheel, the associated component 79, and the ground plate 81.

Mounted on the supporting structure 13 on opposite ends of the holder 77 are identical ejectors 101 and 101*a* (FIG. 1). The ejectors 101 serve the dual functions of a memory for storing the results of the tests of the components 79, and they serve as an implement to eject the components from the holder 79 in accordance with the results of the test.

Figure 7:
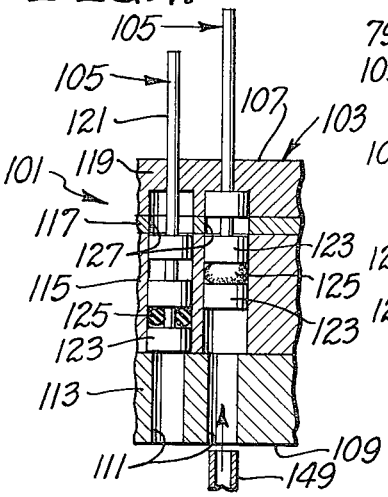
FIG. 7 is a fragmentary, sectional view of the ejector showing one of the ejector members being releasably retained in the extended position and the other of the ejector members being in the retracted position.

Because the ejectors 101 and 101*a* are identical, only the ejector 101 is shown in detail in FIG. 7. The ejector 101 includes a body 103 and a plurality of ejector members 105. In the embodiment illustrated, one of the ejector members 105 of the ejector 101 is provided for each of the components 79, and the ejector members are arranged in the same pattern as the passages 91 of the holder 77. Thus, each of the components 79 has a corresponding ejector member 105 in the ejectors 101 and 101*a*. The body 103 has opposite faces 107 and 109, and a plurality of passages 111 extend between these faces with one of the passages being provided for each of the ejector members 105. The body 103 includes a lower plate 113, an intermediate plate 115, a locking plate 117, and an upper plate 119.

Each of the ejector members 105 is identical and includes a stem 121 having three spaced flanges 123 thereon. The lower two flanges 123 define a seal groove therebetween and a resilient seal 125 is positioned therein. The seal 125 may be of various constructions, and in the embodiment illustrated is in the form of an annular, elastomeric O-ring. The seal 125 frictionally engages the surface defining the passage 111 with sufficient force so as to releasably retain the ejector member 105 in any position in which the ejector member is placed. The lower face of each of the ejector members 105 forms a piston.

Each of the ejector members 105 is movable between a lower or retracted position and an upper or extended position. In the extended position, the stem 121 projects a greater distance from the face 107 than in the retracted position. In the embodiment illustrated, in the retracted position, the lower flange 123 rests on the lower plate 113, and in the extended position the upper flange 123 engages the shoulder formed in the upper plate 119. With reference to FIG. 7, the ejector member on the right is in the extended position and the ejector member 105 on the left is in the retracted position.

The locking plate 117 has a plurality of apertures 129 which form portions of the passages 111, respectively. Although other arrangements can be employed, in the embodiment illustrated, one of the apertures 127 is provided for each of the ejector members 105. The locking plate 117 is slidable relative to the other portions of the body 103 between a releasing position shown in FIG. 7 in which it does not obstruct movement of the ejector member 105 in their respective passages 111 and a blocking position shown in FIG. 8 in which it positively retains the ejector members 105 in either the extended or retracted positions. In the blocking position shown in FIG. 8, a portion of the locking plate 117 fits beneath the uppermost flange 123 of the ejector member 105 on the right to hold that ejector member in the extended position, and it blocks off the passage 111 above the uppermost flange 123 of the ejector member on the left to prevent it from being moved to the extended position. Thus, the seal 125 acts to releasably, lightly hold the ejector members 105 in position, and the locking plate 117 provides a positive lock for the ejector members 105.

Figure 6:
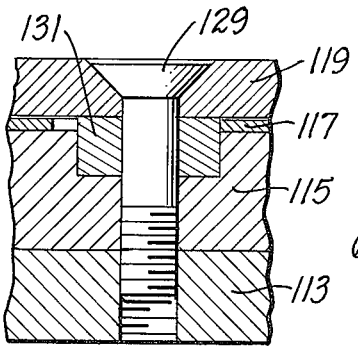
FIG. 6 is a fragmentary sectional view through a peripheral portion of the ejector.

The plates 113, 115, 117 and 119 may be held together in a variety of ways including the manner shown in FIG. 6. These plates can be held together in any way which will permit sliding movement of the locking plate 117. As shown in FIG. 6, a plurality of screws 129 (only one being shown in FIG. 6) are used to attach the plates 113, 115, 117 and 119 together. An annular spacer 131 (only one being shown in FIG. 6) extends around each of the screws 129 and serves to space the intermediate plate 115 and the upper plate 119 sufficiently to provide adequate space for sliding movement of the locking plate 117.

Figure 9:
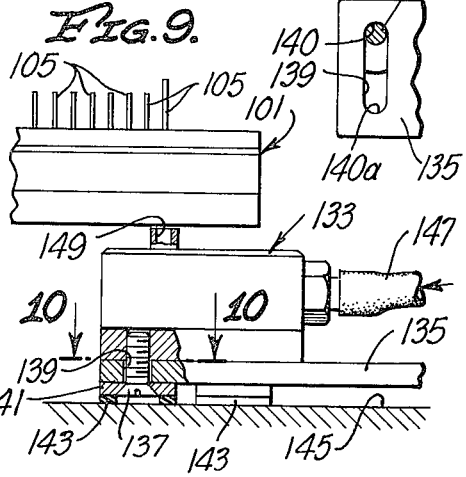
FIG. 9 is a fragmentary, side elevational view taken generally on line 9—9 of FIG. 1 and showing the nozzle assembly and a portion of the ejector.

Identical nozzle asemblies 133 and 133*a* are used to program the ejectors 133 and 133*a*. In the embodiment illustrated, the ejectors 101 and 101*a* are fixedly mounted on the supporting structure 13 and the nozzle assemblies 133 and 133*a* are mounted on the frame 31 by support arms 135 and 135*a*, respectively. As shown in FIG. 9, the nozzle assembly 133 is attached to the arm 135 by a screw 137 which extends through an oversized opening or slot 139 in the arm 135. The slot 139 has opposite end surfaces 140 and 140*a*. The screw 137 loosely clamps the arm 135 between the lower side of the nozzle assembly 133 and a washer 141. The nozzle assembly 133 may include self-lubricating bearings 143 which may be constructed of Teflon and which are adapted to slide along a surface 145 of the supporting structure 13.

The nozzle assembly 133 is adapted to receive fluid under pressure such as air from a conduit 147. The nozzle assembly 133 contains appropriate passages and, if desired, a check valve for transmitting the fluid under pressure from the conduit 147 to an upwardly opening nozzle 149. The nozzle 149 terminates closely adjacent the lower face 109 of the ejector 101 so that it can direct air into the passage 111 immediately thereabove.

The flow of air under pressure to the nozzle assembly 133 is controlled by a valve 151 (FIGS. 1 and 2) which may be an on-off solenoid valve. The solenoid valve 151 may be opened in response to various stimuli including the receipt of an appropriate testing signal from the testing appartus 12. The solenoid valve 151 is suitably mounted on the frame 31 as a bracket 153. The construction and mounting of the nozzle assembly 133*a* is identical to the nozzle assembly 133.

The component handler 11 can be used with many different testing apparatus and the construction will vary depending upon the nature of the test desired. Generally, the testing apparatus 12 should be capable of performing the test rapidly and of providing a testing signal indicative of the results of the test. By way of illustration, if the component 79 being tested in a capacitor chip, the testing apparatus may perform tests to determine capacitance rating, dissipation factor, and forward and reverse leakage. A testing apparatus which will perform these and other functions and provide a testing signal for each component tested is known as the GR 1683 and is available from General Radio, Irvine, California.

In operation of the component handler 11, the plates 85 and 87 are removed from the holder 79 and the components 79 are loaded into the passages 91 of the holder with one of the components being in each of the passages. This loading operation can be carried out in accordance with conventional mass loading techniques.

The X-Y table 15 can be preprogrammed to move the contact assembly 35 and the nozzle assemblies 133 and 133*a* through any desired path or pattern. For example, the platform 17 could first be moved to drive the contact wheel 63 along one full row of the contacts 95, and upon completion of this row, the platform 21 may be moved to index the contact wheel 63 over to the next row whereupon the platform 17 is moved in the opposite direction over the next row of the contacts 95.

Regardless of the path of movement which the X-Y table 15 is programmed to carry out, the platform 21 simultaneously drives the contact wheel 63 and the nozzle assemblies 133 and 133*a* through identical patterns. Thus, by this mechanical arrangement, the position of the nozzles 149 of the nozzle assemblies 133 and 133*a* relative to the contact wheel 63 is known.

When the contact wheel 63 engages one of the contacts 95, a circuit is completed from the testing apparatus 12 through the contact wheel, the associated contact 95, the associated component 79 and the ground plate 81. Although the testing apparatus 12 may perform various different tests, in the embodiment illustrated, it performs two tests, one for each of the ejectors 101 and 101*a*. If the components 79 passes both of these tests, then the testing apparatus 12 provides no signal or a signal of the type which will not result in momentary opening of the valves 151 and 151*a*. If, the component does not pass the test associated with the ejector 101, then the signal from the testing apparatus 12 will cause momentary opening of the solenoid valve 151. This results in a blast of air under pressure from a compressed air source (not shown) through the solenoid valve 151, the conduit 147, and the nozzle 149 to the passage 111 immediately thereabove with the result that the fluid under pressure forces this ejector member to the extended position. The seal 125 prevents escape of the fluid upwardly through the passage 111. In addition, force of friction between the seal 125 and the surface of the passage 111 is sufficient to maintain the ejector member 105 in the extended position.

The contact wheel 63 is moved continuously or intermittently along the contacts 95 so that each of the components can be treated. The contacts 95 project above the upper surface of the holder 77 as shown in FIG. 5 thereby forming an irregular surface of the contact wheel 63. However, the pivotal mounting of the body member 51 on the screw 53 and the use of the spring 55 allows the contact wheel 63 to accommodate the surface irregularities and to properly engage all of the contacts 95.

Figure 8:
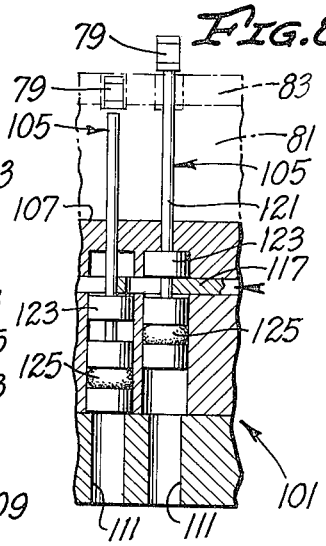
FIG. 8 is a fragmentary view similar to FIG. 7 with the locking plate in position to lock the ejector members in their respective positions and with the holder shown in phantom lines above the ejector.

After all of the components 79 have been tested, the locking plate 117 is moved to the position shown in FIG. 8 to thereby lock the ejector members 105, which have been previously moved to the extended position, in the extended position. Thereafter, the plates 85 and 87 are removed from the holder 77 and the plates 81 and 83 are placed over the ejector members 105 of the ejector 101 as shown in phantom lines in FIG. 8. The stems 121 of the ejectors 105 are sized so as to be receivable within the passages 91 in the plates 81 and 83. The ejector members 105 and the plate 83 are dimensioned so that the ejector members in the extended position are long enough to eject the associated components 79 when the lower face of the plate 81 is placed on the face 107 of the ejector. The ejected components 79 are then swept into an appropriate storage receptacle. The plates 81 and 83 are then moved to the ejector 101*a* where the same procedure is repeated and the components ejected by the ejector 101*a* are placed in a second receptacle. The components still remaining in the holder 77 can be dumped and allowed to fall by gravity into a third receptacle.

Each of the ejectors 101 and 101*a* forms a sorting function in that it ejects from the holder 77 all of those components having a given characteristic such as inability to pass a certain test. It follows, therefore, that the number of ejectors is mere matter of choice depending, for example, upon the number of sorting functions desired.

Figure 10:
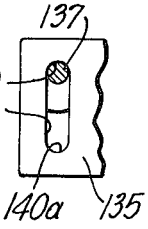
FIG. 10 is a fragmentary, sectional view taken generally along line 10—10 of FIG. 9.

The X-Y table 15 may move continuously or intermittently. If the X-Y table is to move continuously, it may be desirable to have the nozzle 149 lag slightly behind the contact wheel 63. In other words, when the contact wheel 63 is coaxially aligned with one of the contacts 95, the nozzle 149 has not yet become coaxially aligned with the associated passage 111 of the ejector 101. This lag feature may be provided in various different ways. One way is to shift the position of the nozzle assembly 133 relative to the arm 135 as permitted by the oversized opening 139 (FIGS. 9 and 10). Specifically, the loose clamping connection between the arm 135 and the nozzle assembly 133 allows the arm 135 to drive the nozzle assembly 133 with the surface 140 when the arm 135 is moving in one direction and with the surfacae 140*a* when the arm is moving in the opposite direction. The result is that the nozzle 149 lags the contact wheel 63 regardless of the direction of movement of the contact wheel. Thus, the lag feature is made reversible. The length of the slot 139 between the surfaces 140 and 140*a* is selected for the desired amount of lag.

Although the holder 77 is shown as stationary and the contact wheel 63 as being movable, it should be understood that either or both of these elements may be movable to obtain the necessary relative motion therebetween. Similarly, either or both of the ejector 101 and the nozzle assembly 133 may be movable to obtain the necessary relative motion therebetween. The component handler 11 is usable with various different pieces of equipment and the testing apparatus 12 is discussed herein purely by way of example.

Although reference is made herein to testing of the component in the holder 77, it should be understood that various other operations could be performed on the component in lieu of or in addition to testing. Either the contact wheel 63 and/or the holder 77 may be movable relative to the supporting structure 33. Similarly, either the ejector 101 and/or the nozzle assembly 133 can be movable relative to the supporting structure 13. If it is not desired to use the ejector 101 as a tool for directly ejecting the components from the holder, then the arrangement of the ejector members 105 need not be in the same pattern as the components 79.

Although an exemplary embodiment of the invention has been shown and described, many changes, modifications and substitutions may be made by one having ordinary skill in the art without necessarily departing from the spirit and scope of this invention.

We claim:

1. A component handler for use with an apparatus which is adapted to perform an electrical test operation on an electrical component and to provide a signal which is related to such test operation, said component handler comprising:

holding means for holding the electrical component on which the electrical test operation is to be performed;

said holding means including means to establish electrical contact with the component being tested;

means to provide a signal related to the electrical test operation;

a body having a surface defining at least one passage in said body;

at least one member movable in said passage of said body from a first position to a second position; and first means responsive to the signal for providing fluid under pressure for moving said movable member from said first position to said second position whereby the position of said at least one movable member is correlated with the test operation performed on the electrical component.

2. A component handler as defined in claim 1 wherein said movable member and said surface defining said passage define a friction fit at least in said second position whereby the movable member is automatically retainable in the second position.

3. A component handler as defined in claim 1 wherein said movable member includes a resilient seal slidably engageable with the surface defining said passage, the force of friction between said seal and said surface being sufficient to said second position to releasably retain said movable member in said second position and said first means includes means for directing fluid under pressure against said movable member for moving the latter to said second position.

4. A component handler as defined in claim 1 wherein said body includes a locking plate having an aperture therethrough through which said movable member can extend, said plate being slidable in said body to block said passage sufficiently to positively lock the movable member in the second position.

5. A component handler as defined in claim 1 wherein said holding means includes a plurality of conductive contacts electrically couplable, respectively, to said components, said component handler including a supporting structure, a contact wheel and means for mounting said contact wheel on said supporting structure for movement relative thereto and over said conductive contacts, said mounting means including means for resiliently biasing said contact wheel toward said contacts.

6. A component handler for use with an apparatus which is adapted to perform an electrical test operation on an electrical component and to provide a signal which is related to the test operation performed on such component, said component handler comprising:

holding means for holding the component on which the operation is to be performed;

said holding means including means establishing electrical contact with the component being tested;

a body having a surface defining a passage in said body;

a member movable in said passage of said body from a first position to a second position;

means to provide a signal related to the electrical test operation;

means responsive to the signal for moving said movable member from said first position to said second position whereby the position of the movable member is related to the operation performed on the component; and said movable member and said surface defining said passage defining a friction fit at least in said second position whereby the movable member is automatically releasably retainable in said second position.

7. A component handler as defined in claim 6 wherein said movable member includes a resilient seal which engages said surface defining said passage to thereby define said friction fit.

8. A component handler comprising:

a memory including a body having first and second peripheral surface portions and a plurality of passages opening at said first peripheral surface portion;

said memory including a plurality of memory members mounted in said passages, respectively, each of said memory members being movable from a first position to a second position, each of said memory members projecting from said first peripheral surface region at least in said second position thereof;

nozzle means for directing fluid under pressure against said memory members;

a supporting structure;

means for mounting said memory and said nozzle means on the supporting structure for movement relative to each other whereby said nozzle means can be positioned to direct fluid under pressure toward different ones of said memory members to thereby move such memory members from the first position thereof to the second position thereof; and means for controlling the flow of fluid under pressure through said nozzle means.

9. A component handler as defined in claim 8 including first means forming a sufficiently tight frictional fit between at least one of said memory members and the surface of the associated passage at least when said one memory member is in the second position thereof to retain said one memory member in said second position thereof.

10. A component handler as defined in claim 9 wherein said first means includes a resilient seal carried by said memory member.

11. A component handler as defined in claim 9 wherein said body includes a locking plate carried by said body, said locking plate having aperture means therethrough through which the memory members can project, said plate being slidable in said body to block said passages sufficiently to lock the memory member in the second position.

12. A component handler as defined in claim 11 wherein said passages also open at said second peripheral surface portion and said nozzle means directs fluid under pressure into said passages from said second peripheral surface portion to move the memory members from the first position to the second position, each of said memory members including a resilient seal engageable with the surface defining the associated passage, said resilient seal forming a seal for the fluid under pressure and forming a sufficiently tight frictional fit with the surface of the associated passage at least when the memory member is in the second position to retain such memory member in the second position.

13. A component handler comprising:

a supporting structure;

holding means for holding a plurality of components at preselected locations;

a contact;

means for mounting the contact and the holding means on the supporting structure for movement relative to each other so that the contact passes through said preselected locations in a known sequence;

a memory having a plurality of actuable members corresponding to the components, respectively, whereby each of the components is associated with at least one of the actuable members, each of said actuable members having at least first and second stages;

an actuator;

means for mounting said memory and said actuator on the supporting structure for movement relative to each other so that the relative movement between said actuator and said memory occurs along a path, said path including a plurality of predetermined locations, each of said predetermined locations being associated with at least one of said preselected locations and at least one of said actuable members;

said actuator including means responsive to the actuator being at one of said predetermined locations for placing at least one associated memory member in one of said states thereof; and means for relatively moving the actuator and the memory simultaneously with the relative movement between the contact and the holding means with the actuator reaching said one predetermined location shortly after the contact reaches the associated preselected location whereby the actuator lags the contact to provide sufficient time for the actuator to place the associated actuable member in the proper state thereof.

14. A component handler as defined in claim 13 wherein the relative movement between the holding means and the contact occurs first in a first direction and subsequently in a second direction which is generally opposite to said first direction with the actuator lagging the contact when the said relative movement is in said first direction and in said second direction.

15. A component handler for use with a testing apparatus wherein the testing apparatus is adapted to test the components and to provide a testing signal for each of the components which is indicative of the results of the test of such component, said component handler comprising:

holding means for holding the components to be tested in a predetermined pattern;

a contact;

a supporting structure;

means for mounting said holding means and said contact on said supporting structure for movement to each other so that the contact passes along said predetermined pattern;

an ejector including a body having a face and a plurality of passages extending through the body, said ejector including a plurality of ejector members mounted, respectively, in said passages for movement relative to said body, said ejector members being provided in said pattern and being movable from a first position to a second position, said ejector members projecting from said face at least in said second position;

nozzle means for directing fluid under pressure into said passages to move the ejector members in such passages from the first position to the second position;

means for mounting the nozzle means and the ejector on said supporting structure for relative movement relative to each other so that said nozzle means can be positioned to direct fluid under pressure into any of said passages to move the associated ejector member from the first position to the second position;

means providing a testing signal indication of the results of the test of the component;

means for correlating the relative movement between the holding means and the contact with a relative movement between the nozzle means and the ejector whereby each of the components in the holding means can be associated with one of said ejector members; and means responsive to the testing signal for controlling the flow of air from said nozzle means into said passages whereby the position of each of the ejector members in a function of the testing signal for the associate component and the ejector members in at least one of the positions thereof being usable as an implement to remove corresponding components from the holding means.

16. A component handler as defined in claim 15 including resilient means for resiliently urging said contact toward said holding means.

17. A method of testing a plurality of electrical components comprising:

providing a holder having the components retained thereon in a predetermined pattern;

said holder including means establishing electrical contact with each of said components;

electrically testing the components while the components are retained on the holder;

providing a memory having a plurality of movable memory members;

positioning the memory members using fluid under pressure in accordance with the results of the test of said components; and sorting at least some of the components utilizing the positioned memory members whereby the components are sorted in accordance with the results of the test of such components.

18. A component handler for use with a testing apparatus wherein the testing apparatus is adapted to test at least one electrical characteristic of the components and to provide a testing signal for each of the components which is indicative of the results of the test of such components, said component handler comprising:

means for holding the components to be tested;

said holding means including means to establish electrical contact with each of the components being tested;

means to provide a testing signal related to the test of the electrical characteristic of the components;

programmable sorting means for sorting the components in accordance with a program; and means responsive to the testing signals for providing fluid under pressure to program the sorting means in accordance with the testing signals whereby components can be sorted in accordance with the results of the test.

19. A component handler for use with a testing apparatus wherein the testing apparatus is adapted to test at least one electrical characteristic of the components and to provide a testing signal for each of the components which is indicative of the results of the test of such components, said component handler comprising:

a holder for holding the components to be tested;

said holder including means to establish electrical contact with the component being tested;

means to provide a testing signal related to the test of the electrical characteristic of the components;

a memory including a body having a face and a plurality of memory members mounted for movement on said body between a first position in which the memory members project from a face of said body and a second position in which the memory members project a lesser distance from said face; and first means responsive to the testing signals for providing fluid under pressure for positioning the memory members in one of said positions whereby the positions of said memory members relative to said body are controlled by the test results.

20. A component handler as defined in claim 19 wherein said body has a plurality of passages in which said memory members are respectively movably mounted and at least one of said memory members and the surface defining the associated passage form a friction fit at least in the second position of said one memory member.

21. A component handler as defined in claim 20 wherein said one memory member includes a resilient seal slidably engageable with said surface to define said friction fit, said first means selectively directing the fluid under pressure against said one memory member and into the associated passage to position said one memory member, said seal at least assisting in sealing said last mentioned passage against the passing of the fluid therethrough.

* * * * *